US009073378B2

(12) United States Patent
Segura et al.

(10) Patent No.: US 9,073,378 B2
(45) Date of Patent: Jul. 7, 2015

(54) PARTICULATE COLLECTING PAD

(71) Applicants: Liliana L. Segura, Richmond, TX (US); Victor H. Segura, Richmond, TX (US)

(72) Inventors: Liliana L. Segura, Richmond, TX (US); Victor H. Segura, Richmond, TX (US)

( * ) Notice: Subject to any disclaimer, the term of this patent is extended or adjusted under 35 U.S.C. 154(b) by 160 days.

(21) Appl. No.: 13/864,928

(22) Filed: Apr. 17, 2013

(65) Prior Publication Data

US 2014/0312194 A1 Oct. 23, 2014

(51) Int. Cl.

| | |
|---|---|
| ***B43L 3/00*** | (2006.01) |
| ***B42F 9/00*** | (2006.01) |
| ***B42D 17/00*** | (2006.01) |
| ***A47B 97/04*** | (2006.01) |
| *B43K 23/00* | (2006.01) |

(52) U.S. Cl.

CPC ..... *B42F 9/001* (2013.01); *B43K 23/00* (2013.01); *B42D 17/00* (2013.01); *A47B 97/04* (2013.01)

(58) Field of Classification Search

CPC ..... B42F 9/001; B42D 17/00; A47B 97/04; A47B 97/02; B43L 3/00; B43K 23/00; B47L 19/00

USPC ..... 248/451, 441.1, 442.2, 452, 447; 434/408; 40/341; 108/27

See application file for complete search history.

(56) References Cited

U.S. PATENT DOCUMENTS

| | | | | |
|---|---|---|---|---|
| 3,875,396 | A | 4/1975 | Webb | |
| 4,155,310 | A | 5/1979 | Gregory | |
| 4,455,773 | A * | 6/1984 | Denison | 40/352 |
| 4,568,052 | A * | 2/1986 | Solomon et al. | 248/281.11 |
| 4,920,895 | A | 5/1990 | Burke et al. | |
| 5,145,141 | A | 9/1992 | Hunter | |
| 5,292,099 | A * | 3/1994 | Isham et al. | 248/442.2 |
| 5,294,194 | A | 3/1994 | Lombardo | |
| 5,396,846 | A * | 3/1995 | Kelly et al. | 108/91 |
| 5,860,641 | A | 1/1999 | Heath | |
| D595,357 | S * | 6/2009 | Simpson | D19/88 |
| 2009/0206592 | A1 | 8/2009 | Summerhayes | |
| 2012/0091307 | A1 * | 4/2012 | Haynes | 248/451 |

FOREIGN PATENT DOCUMENTS

| | | |
|---|---|---|
| CN | 202458045 | 10/2012 |
| GB | 2140350 | 11/1984 |
| JP | 2012-161926 A | 8/2012 |

OTHER PUBLICATIONS

International Search Report and Written Opinion for PCT Application No. PCT/US2014/030218 dated Sep. 12, 2014.

* cited by examiner

*Primary Examiner* — Tan Le
(74) *Attorney, Agent, or Firm* — JL Salazar Law Firm

(57) ABSTRACT

A portable pad. The pad providing a surface having a raised portion to barricade particles disposed thereon. The pad includes a clip configured to hold a document on the surface.

7 Claims, 5 Drawing Sheets

PARTICULATE COLLECTING PAD

BACKGROUND

The present disclosure relates generally to surfaces and devices for barricading, trapping, or collecting particulate matter.

Surfaces for collecting or trapping liquids are utilized in a wide range of applications. For example, drip pans may be installed beneath water heaters and other liquid containers in order to collect any fluid leaking or overflowing from the tank or container. Commercial cooking grills are equipped with barricading surfaces formed or mounted around the grill's perimeter, to collect and trap grease and other undesired matter discarded from the grill surface. U.S. Pat. No. 4,920,895 proposes a drafting device for use with a drafting board. The device uses a removable trough to collect eraser shavings brushed off from the board.

While such surfaces and devices have been used in various applications, a need remains for an article to barricade, trap, or collect particulate matter in common, every day, user applications.

SUMMARY

In one aspect, the present disclosure relates to a portable pad. The pad providing a surface having a raised portion to barricade particles disposed thereon. The pad includes a clip configured to hold a document on the surface.

In another aspect, the present disclosure relates to a portable pad. The pad providing a surface having a raised portion to barricade particles disposed thereon. The raised portion is along an edge of the surface. The pad includes a clip configured to hold a document on the surface.

In another aspect, the present disclosure relates to a portable pad. The pad providing a surface having a raised portion to barricade particles along an edge of the surface. The pad includes a clip configured to hold a document on the surface.

It is to be understood that both the foregoing general description and the following detailed description are exemplary and explanatory only and are not restrictive of the subject matter, as claimed. It should be understood that the subject matter, in its broadest sense, could be practiced without having one or more features of these exemplary aspects and embodiments.

BRIEF DESCRIPTION OF DRAWINGS

The accompanying drawings illustrate some exemplary embodiments of the present disclosure and together with the description, serve to explain certain features and designs.

DETAILED DESCRIPTION

Reference is now made in detail to various exemplary embodiments of the subject matter, examples of which are illustrated in the accompanying drawings. Wherever possible, the same reference numbers are used throughout the drawings to refer to the same or like parts.

Figure 1:
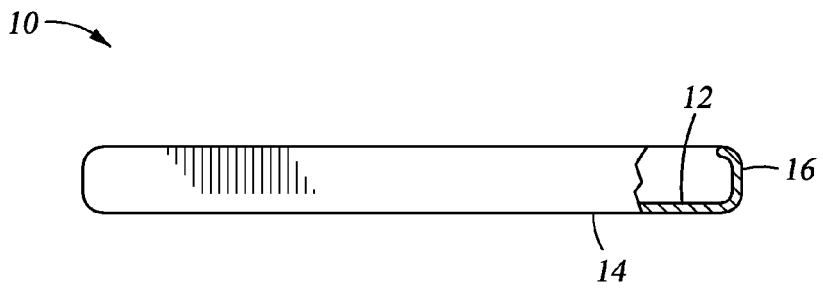
FIG. 1 is a schematic side view of an exemplary embodiment of a pad in accordance with the present disclosure.
Figure 2:
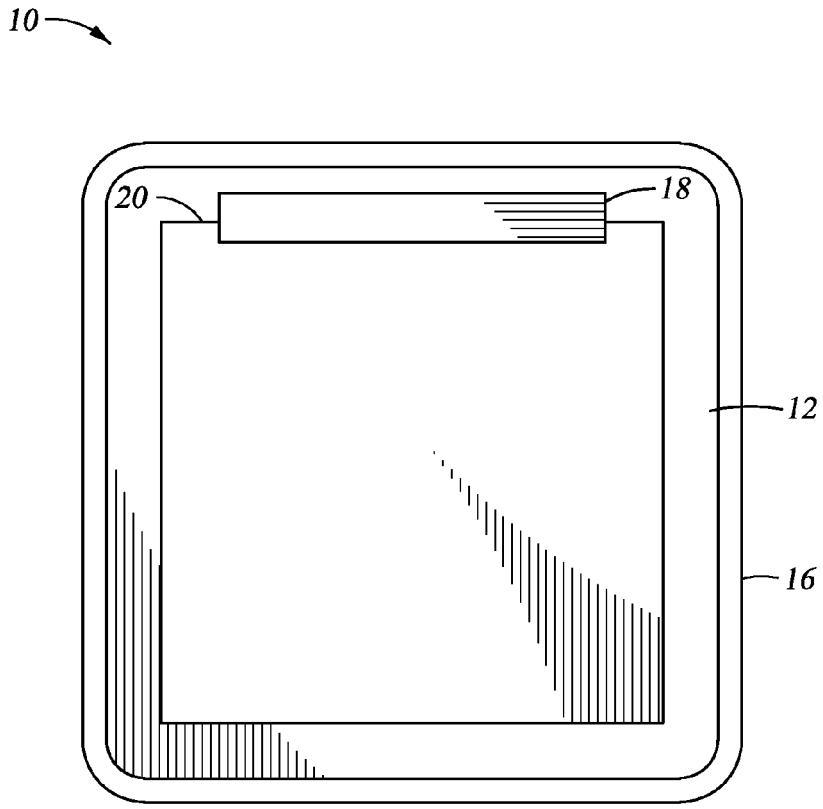
FIG. 2 is a schematic top view of an exemplary embodiment of a pad in accordance with the present disclosure.

Various exemplary embodiments of the subject matter contemplate a portable pad configured with a base member 10 having a top surface 12 and a bottom side 14, as illustrated in FIG. 1. The top surface 12 has a raised portion 16 formed thereon to barricade and collect particulate matter disposed on the surface 12. FIG. 2 illustrates an overhead view of the embodiment of FIG. 1. The base member 10 may be formed of any suitable material to fit the particular use or application. For example, embodiments may be formed from a suitable rubber or plastic material, providing for easy cleaning of the pad. Other embodiments may be formed using metals, composites, or any other materials or combinations of materials, depending on the desired use or application.

The raised portion 16 may be formed from a flexible material, such as rubber, plastic, or a non-rigid compound. Embodiments may be formed with the raised portion 16 having rounded upper wall surfaces, as shown in FIG. 1.

FIG. 2 illustrates a document holder clip 18 disposed on the top surface 12 for holding one or more documents 20. As used herein, the word "document" or "documents" is not to be limited to standard paper documents. The disclosed embodiments encompass documents comprising practically any item that can be held by the holder clip 18 (e.g. a board, plastic sheet, canvas, cloth, non-paper material, etc.).

In one embodiment, the clip 18 is a spring-loaded clip of a well-known design which is secured to the top surface 12 and a portion of which pivots away from the surface under finger or hand pressure from the user to allow paper, forms, or the like to be placed beneath the pivoting portion of the clip 18. With such an embodiment, when the clip 18 is released, a spring force biases the clip downwardly to securely hold the document onto the top surface 12. Other embodiments of the subject matter may be implemented with any conventional document holder clip 18 design as known in the art and as shown in the various embodiments disclosed herein. The holder clips 18 on embodiments of the subject matter may be affixed or secured to the pad surface 12 via any suitable fastener means as known in the art. In some embodiments, the holder clip 18 is mounted on the surface using a suitable adhesive.

Embodiments of the base member 10 may be produced via conventional manufacturing techniques, such as but not limited to, injection molding, casting, 3D printing, etc. Pad embodiments of the subject matter may be formed as a unitary piece or as multiple pieces combined together to form the pad. For example, an embodiment may be configured with the base member 10 comprising a rigid central piece forming the top surface 12 and bottom side 14, with the center piece engaged within a pre-formed rubber piece forming the raised portion 16 perimeter. Other embodiments may be configured with a rigid central piece engaged with a pre-formed rubber piece forming a partial raised portion 16 as described below.

Figure 3:
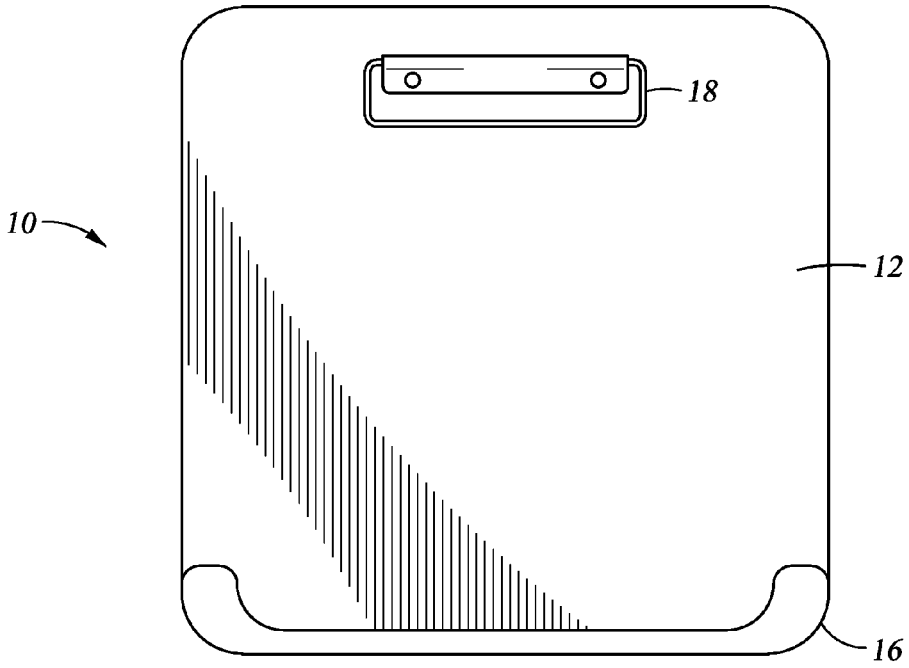
FIG. 3 is a schematic top view of another exemplary embodiment of a pad in accordance with the present disclosure.

While the FIG. 1 and FIG. 2 embodiments are configured with a raised portion 16 formed along the edges of the surface 12 to form a barricade around the perimeter of the base member 10, other embodiments may be implemented with a partial raised portion 16, as shown in FIG. 3. In this embodiment, the raised portion 16 is formed along the lower edges of the pad 10. Other embodiments may be configured with a partial raised portion 16 formed on other sides of the pad 10 or with multiple raised portions having gaps in between (not shown).

Figure 4:
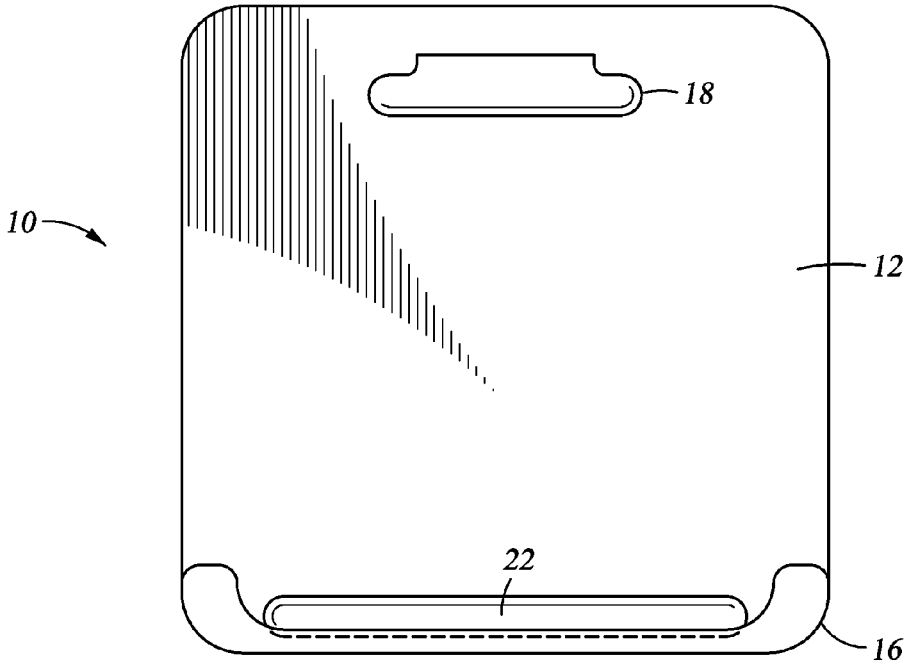
FIG. 4 is a schematic top view of another exemplary embodiment of a pad in accordance with the present disclosure.

FIG. 4 illustrates another embodiment. In this embodiment, a channel 22 is formed on the top surface 12 of the pad. The channel 22 is formed as a recessed groove or trench. The channel 22 provides a trench to collect and hold particulate matter (further described below), or it can be used to hold a hand tool or utensil, such as a painting brush or drawing pencil.

Figure 5:
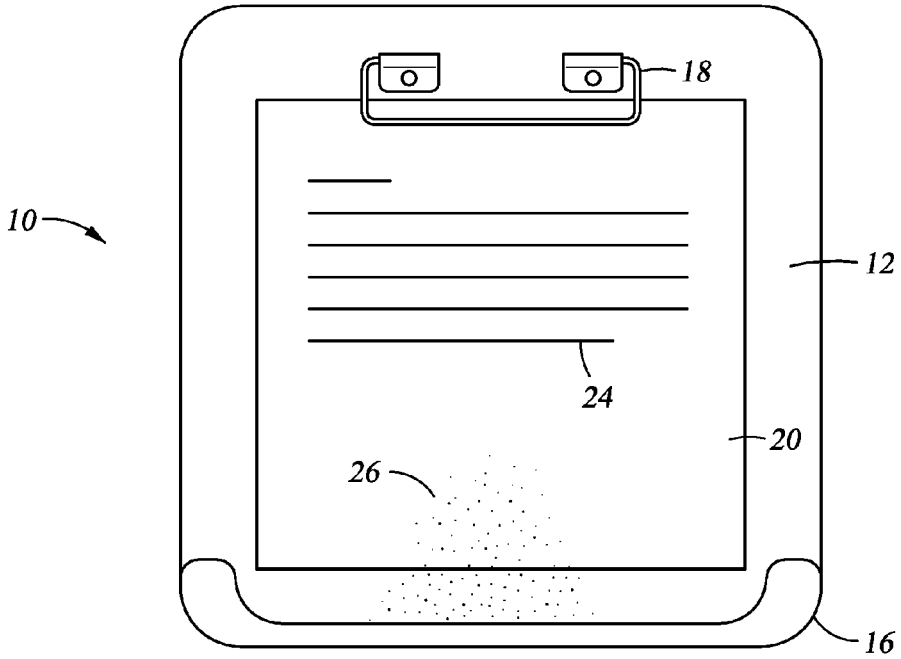
FIG. 5 is a schematic top view of another exemplary embodiment of a pad in accordance with the present disclosure.

FIG. 5 shows an embodiment similar to the embodiment of FIG. 3. The pad 10 is shown with a document 20 held in place by a holder clip 18. In this embodiment, the document 20 is a sheet of paper with pencil-written notation 24. As is common with such notation, eraser shavings are produced when the notation is erased using a conventional eraser (not shown). The eraser shavings form undesired particles 26 which may be brushed off the surface 12, creating a mess in the surrounding area. However, with a pad 10 of the disclosure the shavings 26 and any other particulate matter are collected to avoid undesired debris and mess. The raised portion 16 forms a barricade, trapping and holding the particles 26. With a rubber or plastic raised portion 16, any residue left behind after disposing of the particulate matter 26 can be washed off. As used herein, the words "particle" and "particulate" are interchangeable and not to be limited to any specific size, shape, dimension, or type of matter. The disclosed embodiments encompass particulate comprising liquid or liquid-mass mixtures. The raised portion 16 of the pad 10 embodiments provides a barricade to any such particulate.

Figure 6:
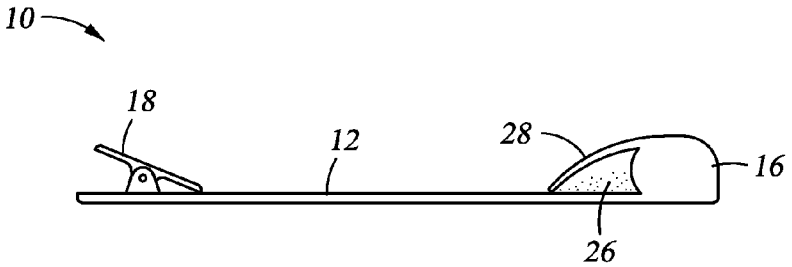
FIG. 6 is a schematic side view of an exemplary embodiment of a pad in accordance with the present disclosure.

FIG. 6 illustrates a side view of another embodiment. In this embodiment, the raised portion 16 is formed with a covering flap 28 that extends over onto the top surface 12. With embodiments formed with rubber or plastic raised portions 16, the flap 28 is a unitary flexible extension of the walled portion. With this embodiment, particles 26 are further trapped when brushed or disposed under the flap 28.

Figure 7:
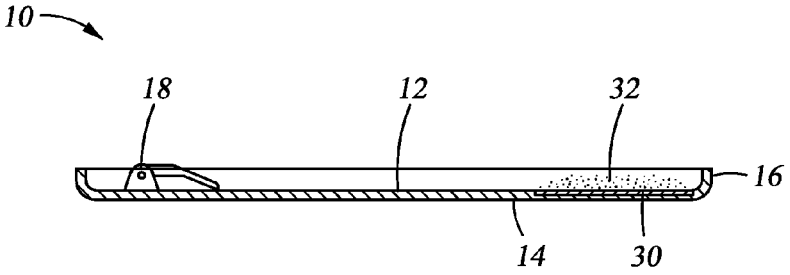
FIG. 7 is a schematic side view of another exemplary embodiment of a pad in accordance with the present disclosure.
Figure 8:
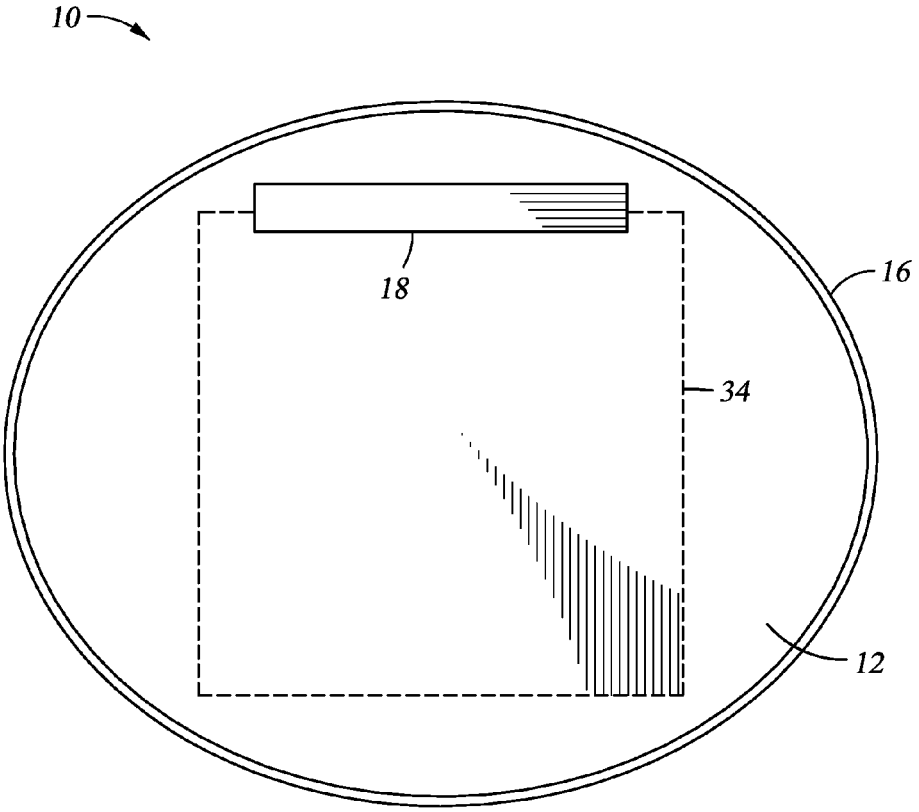
FIG. 8 is a schematic top view of another exemplary embodiment of a pad in accordance with the present disclosure.

FIG. 7 illustrates a side view of another embodiment. In this embodiment, a magnet 30 is mounted on the pad 10 to attract metallic particles 32 disposed on the surface 12. The magnet 30 may be sheathed within the base 10 or affixed on the surface 12 using any suitable means as known in the art. FIG. 8 illustrates another embodiment. In this embodiment, the pad 10 is formed with an enlarged oval-shaped surface 12. Embedded within, affixed to, or forming the surface 12 is a rigid planar member 34. The member 34 provides a hard and solid backing for the surface 12. The member 34 may be formed of any suitable material.

Figure 9:
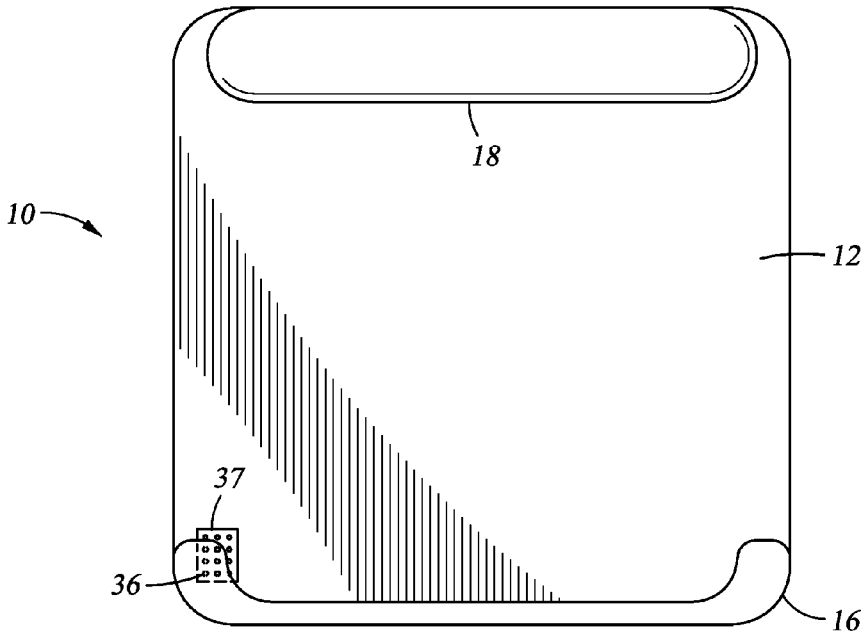
FIG. 9 is a schematic top view of another exemplary embodiment of a pad in accordance with the present disclosure.

FIG. 9 shows another embodiment. In this embodiment, the surface 12 itself extends from the top to form the holder clip 18. The material forming the clip 18 is flexible, yet rigid enough to sustain a document placed under the clip 18 against the surface 12. FIG. 9 also shows an embodiment configured with an abrasive element 36 disposed on the surface 12. The abrasive element 36 may be used to clean a conventional eraser covered with graphite or to scrape undesired material off a hand tool or utensil (not shown). In some embodiments, the abrasive element 36 may be configured as a series of raised or knurled points formed or affixed to the surface 12. For example, pad 10 embodiments formed by injection molding may be implemented with one or more abrasive elements 36 directly formed in the material and distributed along the surface 12 as desired. In other embodiments, the abrasive element 36 may be inserted or affixed within a void 37 formed on the surface 12. One such embodiment may be configured with a void 37 to hold a piece of sandpaper disposed thereon to provide the element 36.

Figure 10:
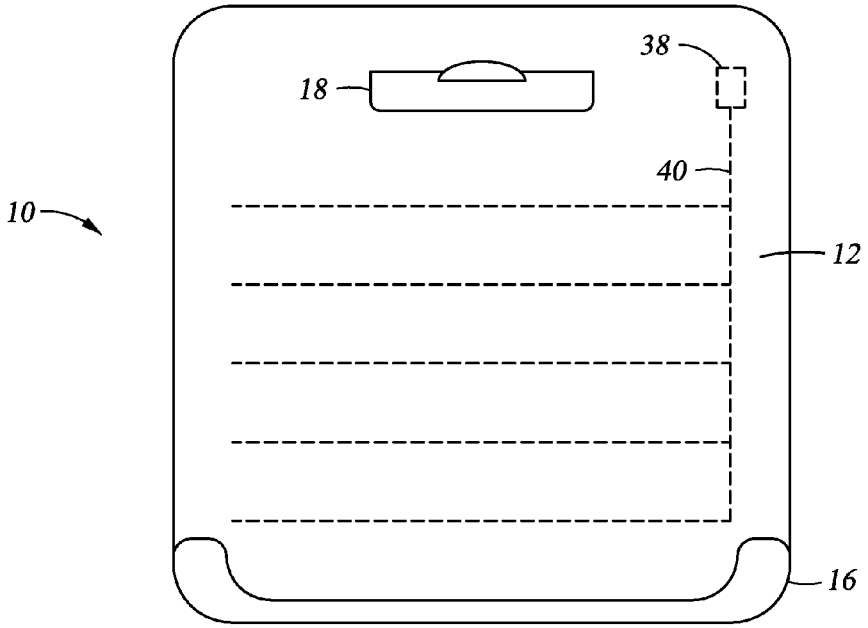
FIG. 10 is a schematic top view of another exemplary embodiment of a pad in accordance with the present disclosure.

FIG. 10 shows another embodiment. This embodiment is configured with a light-emitting element 38 disposed on the pad 10. One such embodiment may be configured with a series of fiber optics 40 embedded within or affixed to the pad 10. The light-emitting element 38 comprises a battery and light source (e.g. bulb or LED) disposed in a void and activated by a switch to provide the light source for the linked fiber optics 40. Embodiments may be configured with any conventional light-emitting element 38 as known in the art (e.g. a series of LEDs). A pad 10 embodiment having a surface 12 formed from a translucent material and equipped with a light-emitting element 38 will illuminate the document placed thereon. Other pad 10 embodiments may be formed from materials configured to glow in the dark.

It will be apparent to those skilled in the art that various modifications and variations can be made to the pads of the present disclosure without departing from the scope the present disclosure and appended claims. For example, a pad 10 embodiment may be implemented for use in small animal dissection applications. Other embodiments of the subject matter will be apparent to those skilled in the art from consideration of the disclosure herein.

What is claimed is:

1. A portable pad, comprising:

a surface having a perimeter comprising a top edge, a bottom edge, a left side edge, and a right side edge, the left side edge connected to a left end of the top edge by a top left corner and to a left end of the bottom edge by a bottom left corner, the right side edge connected to a right end of the top edge by a top right corner and to a right end of the bottom edge by a bottom right corner;

a raised portion to barricade and trap particles disposed thereon, the raised portion forming a perimeter barricade on the surface; and a clip configured to hold a document on the surface;

wherein the raised portion has a perimeter edge extending along an entire length of the bottom edge around the bottom left corner and the bottom right corner, a left end of the perimeter edge of the raised portion terminating at a left barrier end in contact with the surface along the left side edge a distance from the bottom left corner, a right end of the perimeter portion of the raised portion terminating at a right barrier end in contact with the surface along the right side edge a distance from bottom right corner;

wherein the raised portion has an inner edge between the left barrier end and the right barrier end, the inner edge having a linear portion parallel to the bottom edge and curved sides extending from each end of the linear portion; and wherein the raised portion extends upward and away from the surface and arched inward from the perimeter.

2. The pad of claim 1, further comprising a channel formed on the surface to collect particles.

3. The pad of claim 1, wherein the raised portion comprises a flap extending over the surface.

4. The pad of claim 1, further comprising a light emitting element disposed thereon.

5. The pad of claim 1, further comprising a magnet disposed thereon to attract metallic particles disposed on the surface.

6. The pad of claim 1, wherein the raised portion is formed of a flexible material.

7. The pad of claim 1, further comprising an abrasive element disposed on thereon.

* * * * *